US006000755A

United States Patent [19]

Uhlenbrock

[11] Patent Number: 6,000,755

[45] Date of Patent: Dec. 14, 1999

[54] SWIVEL CHAIR

[76] Inventor: Johannes Uhlenbrock, An der Werse 5, D-48317 Drensteinfurt, Germany

[21] Appl. No.: 09/100,909

[22] Filed: Jun. 19, 1998

[30] Foreign Application Priority Data

Jun. 20, 1997 [DE] Germany ..... 197 26 160

[51] Int. Cl.[6] ..... A47C 1/024

[52] U.S. Cl. ..... 297/300.2; 297/300.7; 297/300.4; 297/316

[58] Field of Search ..... 297/300.1, 300.2, 297/300.4, 300.5, 300.7, 300.8, 316, 320

[56] References Cited

U.S. PATENT DOCUMENTS

| | | | |
|---|---|---|---|
| 3,989,297 | 11/1976 | Kerstholt | 297/300.8 |
| 4,709,962 | 12/1987 | Steinmann . | |
| 4,865,384 | 9/1989 | Desanta | 297/300.4 |
| 5,308,144 | 5/1994 | Korn | 297/300.2 |
| 5,584,533 | 12/1996 | Schrewe | 297/300.4 |
| 5,660,439 | 8/1997 | Unwalla | 297/300.2 |

FOREIGN PATENT DOCUMENTS 43 12 113 C1 10/1994 Germany .

44 39 290 A1 5/1996 Germany .

*Primary Examiner*—Peter M. Cuomo
*Assistant Examiner*—Anthony D. Barfield
*Attorney, Agent, or Firm*—Hill & Simpson

[57] ABSTRACT

An office swivel chair is provided comprising a foot with a center column extending upwards therefrom, wherein the center column may be variable in length and/or spring mounted, a seat carrier is secured at the upper end of the center column, a seat top pivotable around a horizontal axis close to the front edge of the seat top, is connected with the seat carrier, and is biased by a spring arrangement with an upwards directed force, and a back rest attached at least one upwards extending lever which is articulately connected with the seat carrier at a first link point under the seat top, and spaced therefrom is articulately connected with the underside of the seat top at a second link point wherein, both link points comprise swivelling axes in parallel with the seat top swivelling axis. The length of the lever between the first link point and the second link point is variable by displacing the first link point and/or the second link point in the direction of the lever.

16 Claims, 5 Drawing Sheets

SWIVEL CHAIR

BACKGROUND OF THE INVENTION

The present invention relates to a seat, in particular an office swivel chair comprising a foot with a center column extending upwards therefrom, wherein the center column may be variable in length and/or spring mounted, a seat carrier secured at the upper end of the center column, a seat top pivotable around a horizontal axis close to the front edge of the seat top, connected with the seat carrier, and biased by a spring arrangement with an upwards directed force, and a back rest attached to at least one upwardly extending lever which is articulately connected with the seat carrier at a first link point under the seat top, and, spaced therefrom, is articulately connected with the underside of the seat top at a second link point, wherein both link points comprise swivelling axes in parallel with the seat top swivelling axis.

A seat of the type mentioned is known from U.S. Pat. No. 4,709,962. With such a seat, the lever carries the back rest and is linked at the seat carrier and the seat top, and serves for generating a coupled movement of seat top and back rest. More specifically, the coupling is comprised such that the back rest also pivots when the seat top is pivoted, however, in a different angle than the seat top. The ratio of the pivot angles to each other is set at a predetermined value in the range between approximately 1.1.3 and 1.2.5 with seats known in the current market. With this construction of the seat, in particular, the user of the seat may take his/her position between an upright position with a raised seat top and a straight backwards directed back rest, and a reclined position with a seat top lowered in the rear area and a back rest in an angled position, thereby avoiding the situation that when changing the seat position the back rest will shift at the back of the user upwards or downwards in an unpleasant way.

A further relevant seat is known from German published application 43 12 113 C1. This document describes a seat with the seat adjustable in the inclination thereof and pivotable around a horizontal swivelling axis in the front area, and a back rest with an over proportional inclination in relation to the inclination change of the seat. Therein the seat is articulately connected with swivelling levers with one end thereof carrying the back rest, and with the other end thereof rotatably supported at the bearing support of the chair structure. The swivelling levers are spaced from the rear end of the seat and linked thereto, and the sections of the swivelling levers are rotatably supported at the bearing support, and take an obtuse angle towards the support area in relation to the sections of the swivelling levers adjacent to the link axis of the seat. Furthermore, a return spring is provided to automatically reset the seat top and the back rest from the idle position into the working position when the load is released. In order to adapt the seat to a wide range of user weights it is provided with this seat that the swivelling axis of the swivelling levers is displaceable in relation to the bearing support, and that the return spring is arranged between the bearing support and the sections of the swivelling levers rotatably supported at the bearing support, and that it is adjustable in the mounting position in relation to the swivelling bearings variable, such that the torque exerted by the spring force around the swivelling axis is variable. It is not provided that the ratio between the swivelling angle of the seat and the swivelling angle of the back may be varied with the seat.

From German published application 44 39 290 A1, a synchronous adjusting device for office chairs, seats and the like is known comprising a seat member, a back member with a back rest attached to a back carrier or integrated therein, and a stationary carrier construction to which the seat member is linked, wherein the back carrier is connected with the seat member and the carrier structure, and the seat member carries out a swivelling movement when the back inclination is enlarged. In order to keep the number of link points, and the number of the additional connecting points, low and to lower the construction effort of such a synchronous adjustment device, it is provided that the back carrier is directly pivotally connected with the seat member and with the carrier structure. In an embodiment of this adjustment device, with at least one of the swivelling connections, a shifting gate for the turning axis is provided for overlapping a displacing movement with a rotational movement around the swivelling axis. Thereby influence may be taken on the course of the synchronous movements of the seat member and the back member with a corresponding shape of the shifting gate. It is a disadvantage of this synchronous adjustment device that the course of the synchronous movements of the seat member and the back member is set by the shape of the shifting gate, and may no longer be influenced by the user of the seat. Furthermore, with this example of the seat, a synchronous adjustment is provided in such a way that when pivoting the back rest backwards, the seat top is raised in its lower area, and that vice versa when pivoting the back rest to the front, the seat top is lowered in the rear area. This kind of synchronous adjustment is considered no longer to be ergonomicly advantageous.

It is a disadvantage of all these known prior art seats that, because of the preset ratios between the swivelling angles of seat top and back rest, there is always a compromise between the different requirements of various users which occurs because of different anatomical conditions. The ratio of the swivelling angles of seat top and back rest is always preset when manufacturing the seat, and afterwards may not be changed by the user.

SUMMARY OF THE INVENTION

It is therefore an object to provide a seat of the type mentioned above which avoids all the cited disadvantages, and which in particular enables a change at will of the ratio of the tilting angles of seat top and back rest by the user of the seat in order to better adapt the seat to the different requirements of comfort and anatomical conditions of different users.

According to the invention, this object is attained with a seat of the type mentioned before which is characterized in that the length of the lever between the first link point and the second link point is variable by displacing the first link point and/or the second link point in the direction of the lever.

As the length of the lever between the first and second link point defines the ratio of the tilting angles of seat top and back rest, in this way an advantageous possibility is provided to influence the ratio of the tilting angles. For displacing the first and/or second link point advantageously such technical means are used, that the displacement may be accomplished by the seat user. In this way, each user of the seat may select and set a pleasant and appropriate ratio of the tilting angle of seat top and back rest. As a rule, it is sufficient to either displace the first or the second link point. In case a particularly large range of variation of the ratio of the tilting angles is required, it may be practical to displace both link points.

Independent from the fact whether the first link point or the second link point is displaceable, or whether both link points are displaceable, the back rest may either be attached rigidly at the upper free end of the lever or may be linked at the upper free end of the lever swivelling around an axis which is in parallel with the seat top swivelling axis.

BRIEF DESCRIPTION OF THE DRAWINGS

In the following, two embodiments of the seat according to the invention are further explained referring to a drawing.

DETAILED DESCRIPTION OF THE PREFERRED EMBODIMENTS

Figure 1A:
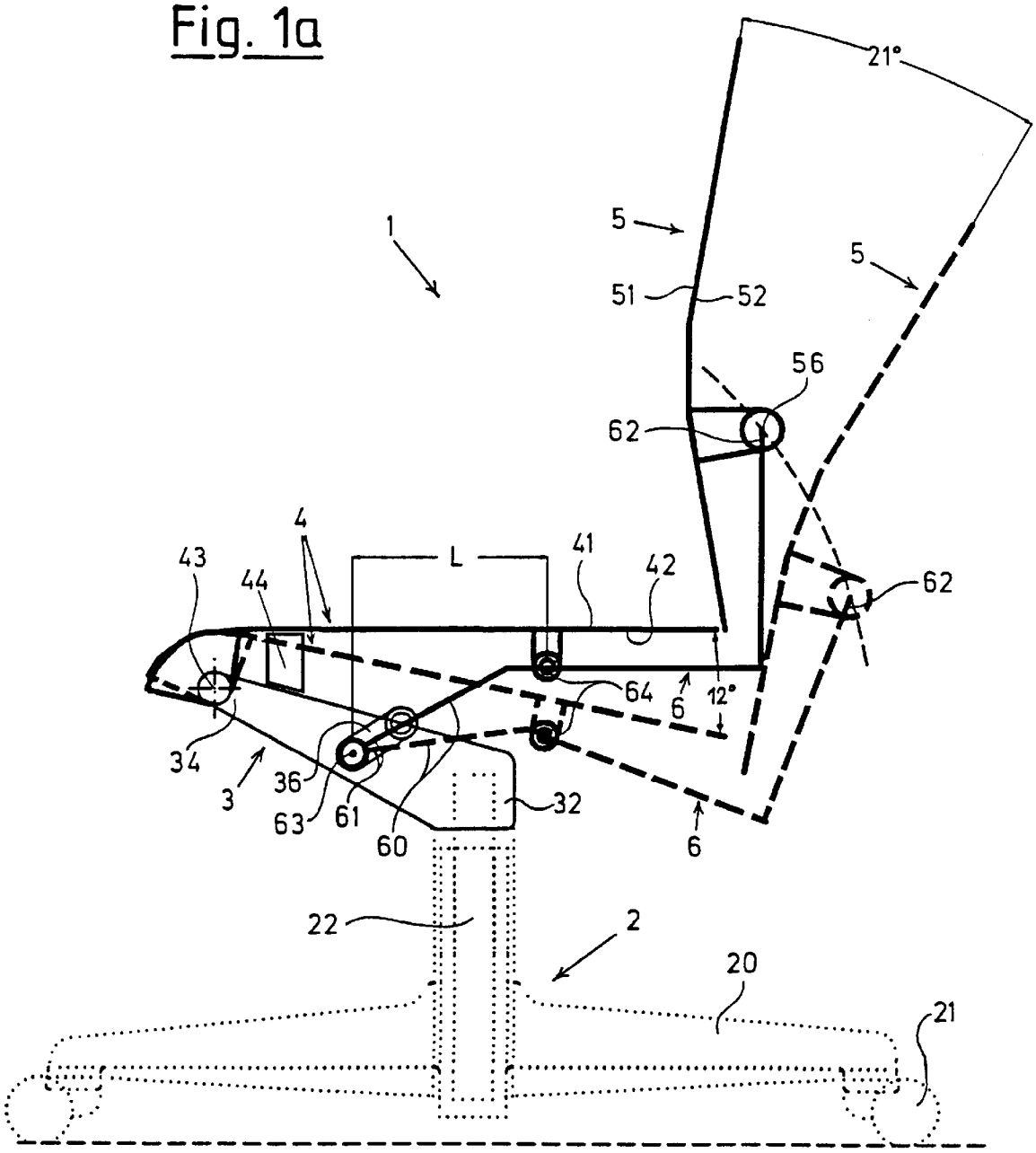
FIG. 1*a* schematically illustrates a side view of a scat in a first embodiment with a first tilting angle ratio between seat top and back rest, in two different tilting positions.

According to FIG. 1*a*, the illustrated embodiment of a seat 1, in this case an office swivelling chair, comprises a foot 2, a seat carrier 3 connected with the foot 2, a scat top 4 pivotably linked to the seat carrier 3, and a back rest 5.

The foot 2 comprises several, generally five, arms 20 which carry at the outer end thereof a roller 21. The foot 2 further comprises a center column 22 extending centrally upwards, and being variable in length and/or spring mounted. The foot 2 in total is of known construction and for this reason is illustrated in dashed lines in the drawing.

The seat carrier 3 with one end 32 thereof is secured to the upper end of the center column 22, wherein lifting the seat carrier 3 upwards from the center column 22 is prevented, however, a rotation of the seat carrier 3 around the center column 22 is still possible.

The seat carrier 3 extends upwards at an angle wherein the outer end 34 thereof is connected to the scat top 4 by means of a swivelling axis 43 which extends in a horizontal direction parallel to the front edge of the scat top 4. Preferably the swivelling axis 43 is designed as a corresponding joint. As an alternative, the swivelling axis 43 may be fabricated of a flexible material which enables a corresponding swivelling movement of the seat top 4 in relation to the seat carrier 3. A spring element, for example a torsion firing 44, is provided between the seat carrier 3 and the seat top 4. The spring element 44 biases the seat top 4 with an upwards directed force rearwardly of the axis 43. When using a flexible material, a spring force may be exerted by the material itself which must be sufficiently flexible and resilient.

The back rest 5 extends upwards from the rear end of the seat top 4, which is at the right side of the drawing, wherein no direct connection exists between the seat top 4 and the back rest 5. The back rest 5 is connected with the remaining part of the seat 1 by means of a lever 6. The lever 6 is connected with the seat carrier 3 and with the seat top 4 in two link points 63 and 64. The link point 63 is designed as a link element which is displaceable and lockable in a guide 36 in the seat carrier 3. On the other hand, the link point 64 is stationarily secured at the underside 42 of the scat top 4, wherein a displacement of the lever 6 in the longitudinal direction thereof is possible through the link point 64. The front end 61 of the lever 6, which is the left end in the drawing, is secured against a movement in longitudinal direction thereof in the link point 63. At the right side of the second link point 64, the lever 6 firstly extends backwards below the seat top 4, which is to the right side in the drawing, and thereupon is angled upwards. The lever 6, at the upper end 62 thereof, is connected to the back rest 5, wherein in the illustrated embodiment the back rest 5 is connected with the lever end 62 pivotally around an axis 56.

The upper side 41 of the seat top 4, and the front side 51 of the back rest 5, are upholstered in the usual way and provided with a cover, e.g., of cloth or leather.

In FIG. 1*a*, a position of the seat 1 with a raised seat top 4 is illustrated in straight lines, in which position the user of the seat 1 takes an upright position. By moving his weight, the user of the seat 1 may change his position at the seat 1, and move the seat top 4 against the force of the spring element mentioned, into a position extending in an angle backwards and downwards, which position is illustrated in dashed lines. The available tilting range of the seat top 4 in each case is 12° in the illustrated embodiment according to FIG. 1*a* and also in the further figures of the drawing.

Figure 1B:
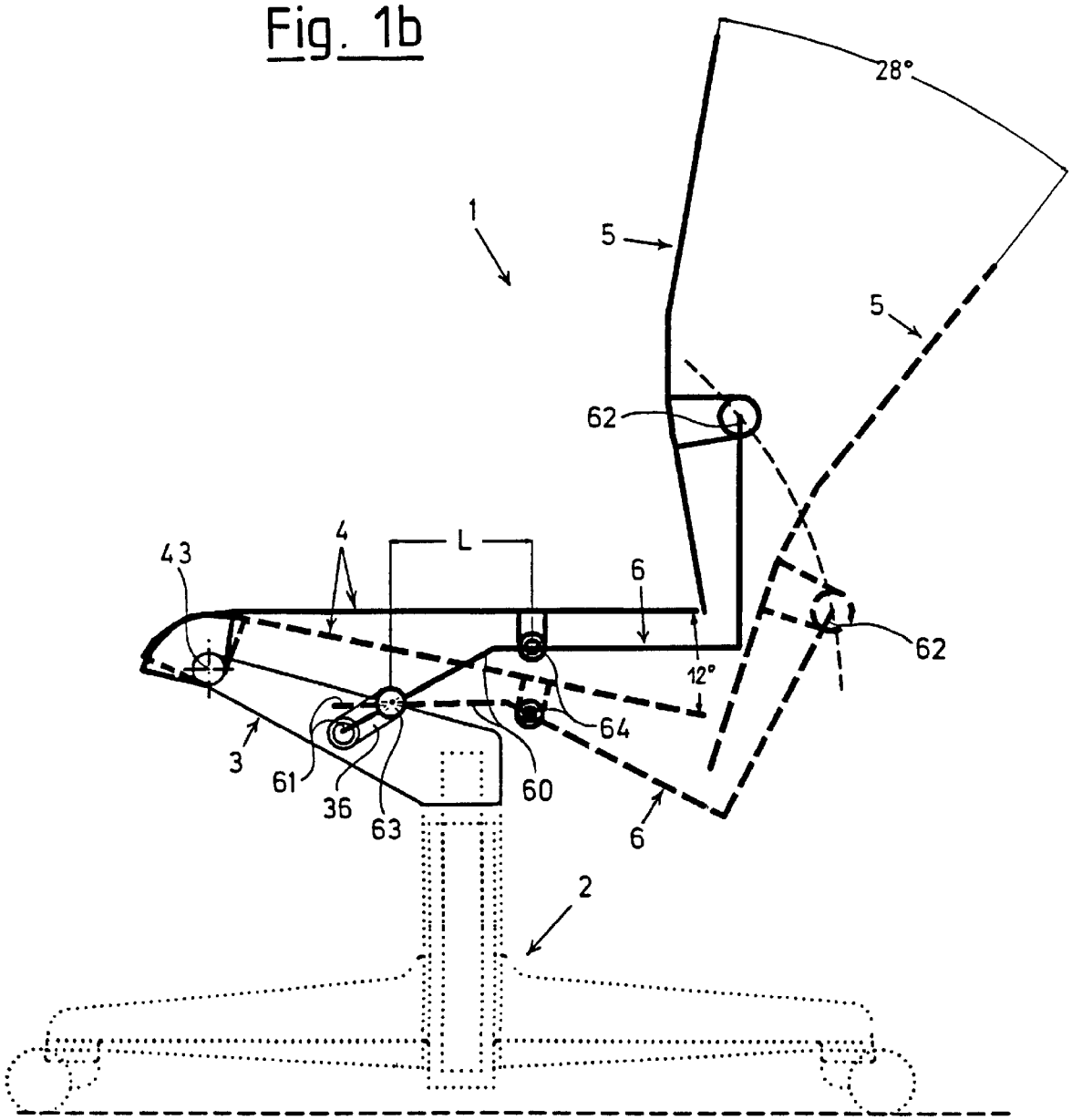
FIG. 1*b* schematically illustrates a side view of the seat of FIG. 1*a* with a changed tilting angle ratio.

By connecting the back rest 5 through the lever 6 with the seat top 4 and the seat carrier 3, on the one hand a transfer of the force of the spring element mentioned also to the back rest 5 is attained, and on the other hand a coupled movement of the seat top 4 and back rest 5 is attained, which in the illustrated embodiment according to FIG. 1*a* is such that the back rest 5 covers a tilting angle of 21° when swivelling the seat top 4 by 12°. The length L of the lever section 60 between the two link points 63 and 64 governs the ratio between the tilting angles of seat top 4 and back rest 5. In the condition according to FIG. 1*a*, the link point 63 is secured at the left end of the guide 36 in the seat carrier 3. For changing the swivelling angle ratio between the seat top 4 and the back rest 5, the link point 63 may be displaced in its guide 36. FIG. 1*b* illustrates the condition of the seat 1 wherein the link point 63 has been displaced to the right upper end of the guide 36 and locked there. By this displacement of the link point 63, the length L is changed to a smaller dimension. This decrease of the length L has the consequence that with the same swivelling of the seat top, 4 which is again by 12°, the back rest 5 now travels through a larger tilting angle which in the example illustrated is 28°.

With the seat 1 according to FIG. 1*a* and FIG. 1*b*, the swivelling angle ratio between the swivelling angles of scat top 4 and back rest 5 may be changed between approximately 1:1.75 and 1:2.3 by displacing the link point 63 from the one end of its guide 36 to the other end. Therein the link point 63, for practical reason, is designed with such technical means that the user of the seat 1 himself may accomplish the displacement within the guide 36 as well as the locking in the required position the link point 63 may be adapted to be continuously displaceable and lockable relative to said guide 36, or may be adapted to be displaceable and lockable relative to said guide 36 in discretely spaced steps. Thus, the user of the seat 1 may adapt it in an optimal fashion to his comfort requirements and anatomical conditions.

Figure 2A:
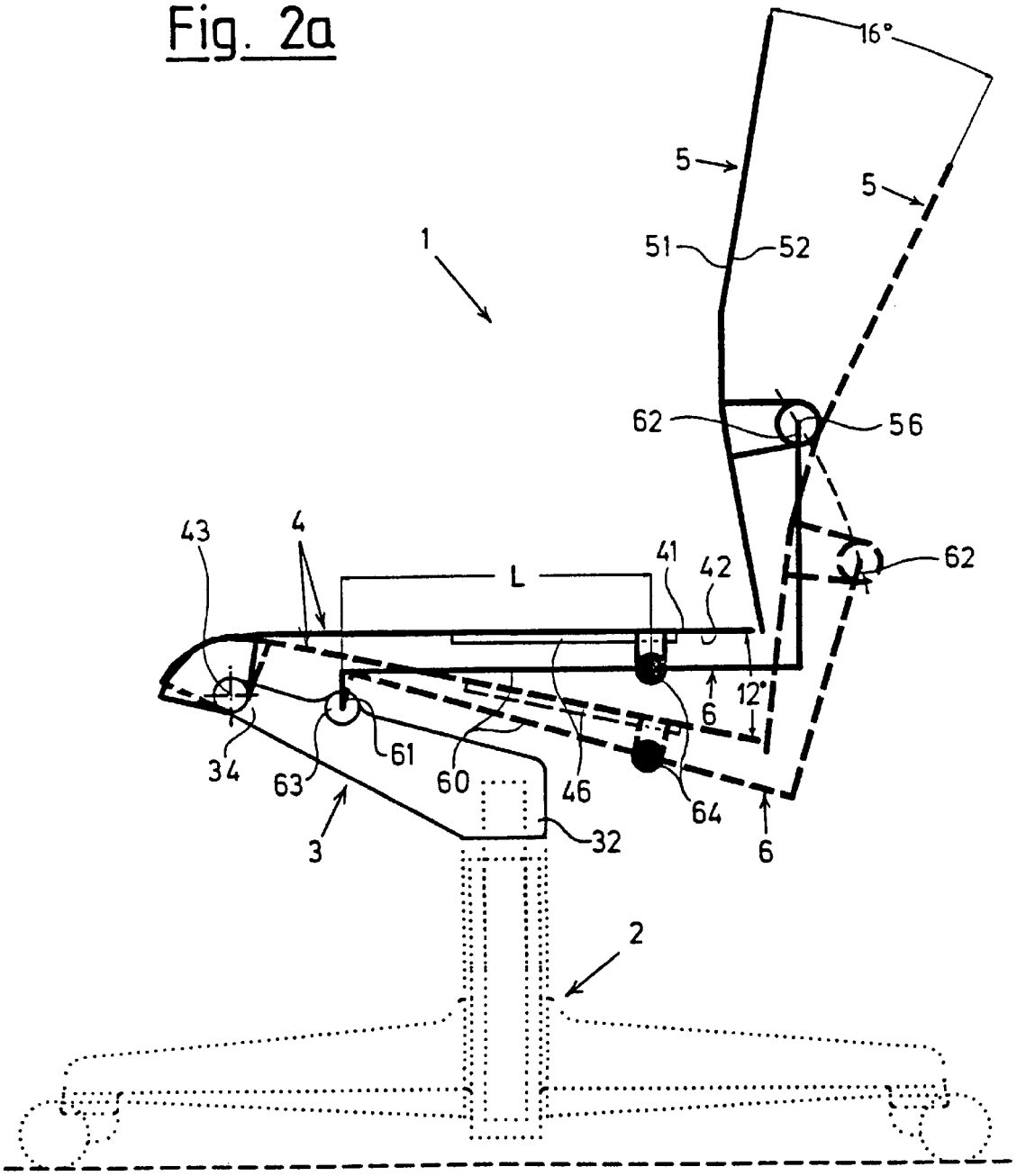
FIG. 2*a* schematically illustrates a side view of the seat in a second embodiment, with a first tilting angle ratio between seat top and back rest.
Figure 2B:
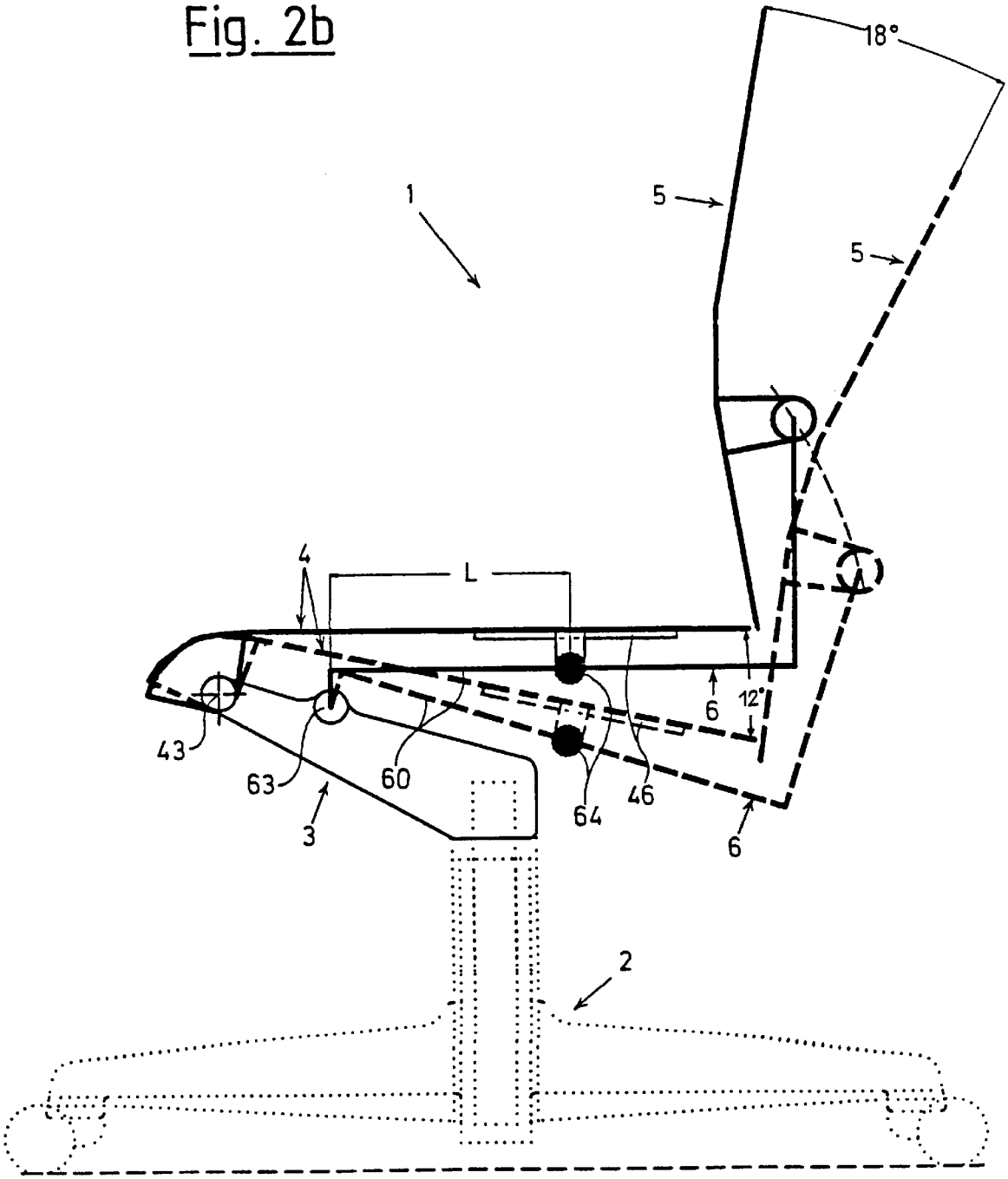
FIG 2*b* schematically illustrates a side view of the seat of FIG. 2*a* now in a second swivelling angle ratio.
Figure 2C:
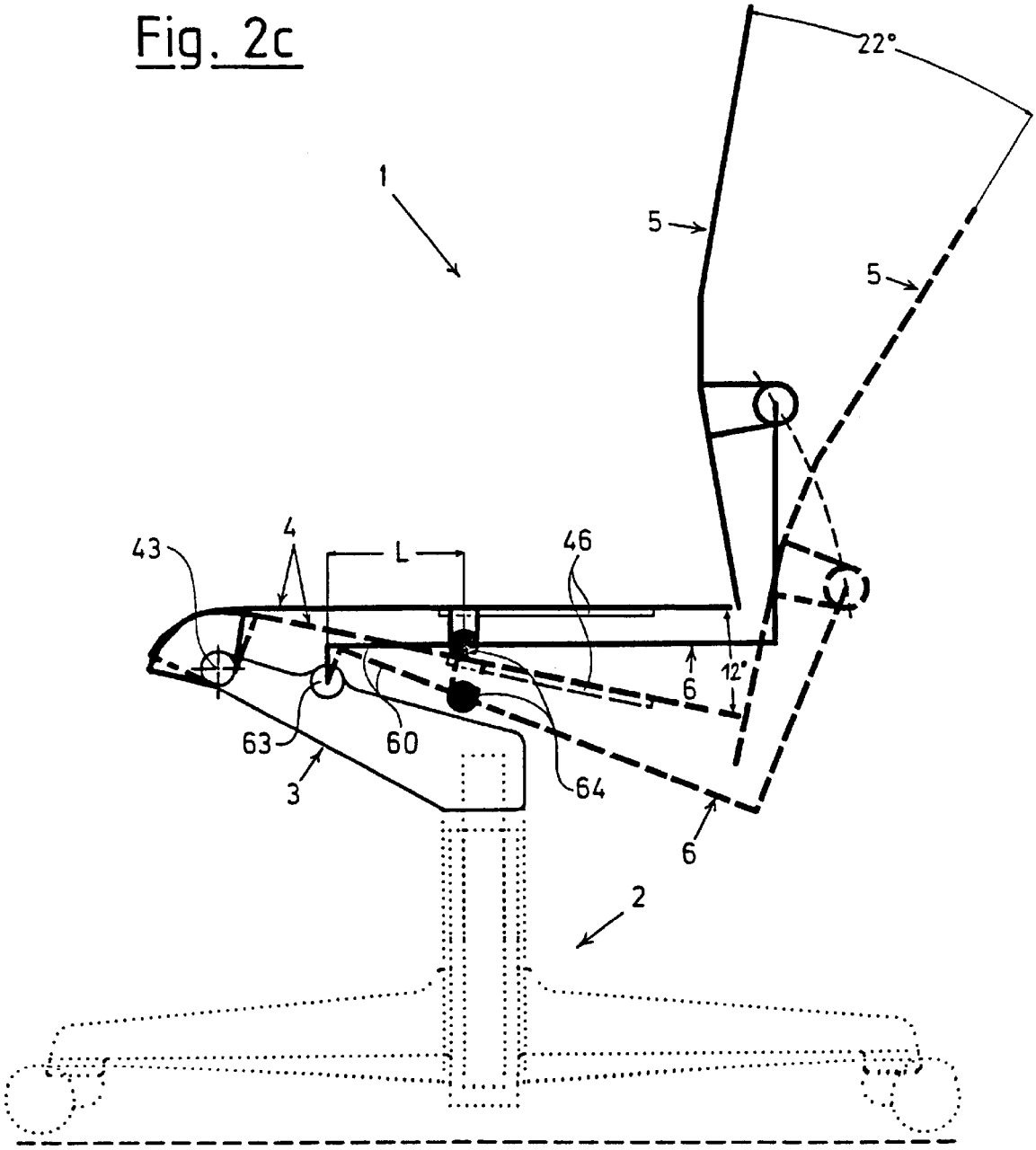
FIG. 2*c* schematically illustrates a side view of the seat of FIG. 2*a* now in a third swivelling angle ratio.

FIGS. 2*a* to 2*c* illustrate an embodiment of the seat 1, wherein other than in the previous embodiments according to FIG. 1*a* and FIG. 1*b*, the second link point 64 may be varied in the position thereof, whereas the first link point 63 is stationary at the seat carrier 3.

According to FIG. 2, this embodiment comprises the seat 1 which again is an office swivel chair, and a known foot, 2 to the upper end of which the seat carrier 3 is attached with its lower end 32. Also in this case, the seat top 4 is articulately connected around the swivelling axis 43, or with the same effect connected with the seat carrier 3 and the free end thereof, in a flexible fashion. The back rest 5 again extends upwards behind the seat top 4.

The back rest 5 is connected with the remaining part of the seat 1 by a lever 6, with the lever 6 extending below the seat top 4 at the underside 42 thereof, and being angled upwards behind the seat top 4 and carrying the back rest 5 at its free end 62. Also in this case a swivelling connection is provided with an axis 56.

In order to have the second link point 64 adjustable, a guide 46 is provided at this seat 1 at the underside 42 of the seat top 4, and along the guide 46, the second link point 64 may be displaced and locked in the desired position, with the second link point 64 formed as a link element the second link point 64 may be adapted to be continuously displaceable and lockable relative to said guide 46, or may be adapted to be displaceable and lockable relative to said guide 46 in discretely spaced steps. The lever 6 extends through the second link point 64, wherein a relative movement between the lever 6 and the link point 64 remains possible in longitudinal direction of the lever.

The front end 61 of the lever 6 is movably supported in the first link point 63 around a horizontal axis which is parallel to the swivelling axis 43, however, the front end is secured against movement in other directions.

Also with this seat 1 there is a coupled movement of seat top 4 and the back rest 5 by the connection of the back rest 5, by the connection of the back rest 5 through the lever 6 with the seat top 4 and the scat carrier 3, when the seat top 4 is lowered by the load of a user. Again, the length L of the lever part 60 between the two link points 63 and 64, governs the swivelling angle ratio between the seat top 4 and the back rest 5. In the condition illustrated in FIG. 2*a*, the second link point 64 or the link element forming the link point, respectively, is displaced approximately to the stop at the back side in its guide 46, whereby the length L approximately takes its maximal possible value. With this position of the second link point 64 a swivelling angle of 16° results for the back rest 5 with a swivelling angle of the scat top 4 of 12°. The swivelled position of the seat top 4 and the back rest 5 is illustrated in dashed lines in FIG. 2*a* and also in the following figures.

In FIG. 2*b*, the seat 1 of FIG. 2*a* is illustrated in an approximately middle position of the second link point 64 within its guide 46, whereby the length L takes a middle value of the possible values for the length L. With this adjustment of the second link point 64 in the embodiment illustrated, there results a coupled swivelling of the back rest 5 by 18° when the seat top 4 is swivelled by 12°.

Finally, FIG. 2*c* illustrates the seat 1 of FIG. 2*a* and 2*b* now in a third position of the second link point 64 wherein the link point is displaced to the front as far as possible within its guide 46. The length L approximately reaches its minimal possible value which leads to the fact that when tilting the seat top 4 by 12° the back rest 5 will swivel by 22°.

As it is further illustrated in FIGS. 2*a* to 2*c*, when swivelling the back rest 5, simultaneously a certain downwards movement occurs in relation to the seat top 4 which gives the user of the seat 1 a pleasant feeling, as shifting movements of the back rest 5 in relation to the back of the user are avoided.

Also, in the seat 1 according to FIGS. 2*a* to 2*c*, the link element forming the second link point 64, together with its guide 46, is designed such that a user of the seat 1 may accomplish the displacement and locking of the link point 64 within its guide 46 by himself. Preferably the embodiment is such that no tool is required for the adjustment, but only a hand wheel or a lever must be actuated, as known, e.g., from manual height adjustment or back adjustment of seats, in particular office swivel chairs.

Since the guide 46 at the underside 42 of the seat top 4 may be designed in great length without any problems a correspondingly large range of variation will result for the length L, and at the same time a correspondingly large range of variation for the swivelling angle ratio between the seat top 4 and the back rest 5. In the example according to FIG. 2*a* to 2*c*, the swivelling will be provided angle ratio may be varied between 1:1.3 to 1:1.8 by displacing the link point 64. An even larger range of variation is possible when the range of variation of the length L is additionally enlarged, either by enlarging the guides 36 and/or 46, or by use of two displaceable link points 63 and 64.

For limiting the manufacturing effort, preferably a single lever 6 is used which for practical reasons extends approximately centrally below the seat top 4 and behind the back rest 5. As an alternative, a pair of levers may be used symmetrically left and right of the seat 1, wherein the two levers 6 may extend over a part of the length thereof adjacent the seat top 4, or directly at the edge areas thereof which may increase the accessibility for displacing the link points 63 and 64. Furthermore, the different embodiment and arrangement of the lever 6 or the levers 6 may offer multiple manifold design possibilities for the outer appearance of the seat 1.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An office swivel chair comprising a foot with a center column extending upwards therefrom comprising:

a seat carrier secured at an upper end of said center column, a seat top pivotable around a horizontal axis close to a front edge of said seat top, connected to said seat carrier, and biased by a spring arrangement with an upwards directed force, at least one lever extending in a first direction and having an upwards extending portion, a back rest attached to said at least one lever at said upwards extending portion, a first link element secured to said seat carrier under said seat top, and a second link element secured to an underside of said seat top, at least one of said first link element and said second link element being displaceably mounted in a guide such that said at least one link element is movable toward or away from the other of said link elements in said first direction of said lever, said at least one lever being articulately connected to said seat carrier at said first link element, and spaced therefrom, being articulately connected with said second link element, wherein both link elements comprise swivelling axes parallel to said seat top pivoting top axis, and wherein a length of said at least one lever, between said first link element and said second link element, is variable by displacing at least one of said first link element and said second link element in said first direction of said lever.

2. A chair according to claim 1, wherein said first link element may be releaseably lockable relative to said guide in said seat carrier.

3. A chair according to claim 2, wherein said first link element is adapted to be continuously displaceable and lockable relative to said guide.

4. A chair according to claim 2, wherein said first link element is adapted to be displaceable and lockable relative to said guide in discretely spaced steps.

5. A chair according to claim 2, wherein said link point is a swivelling bearing secured at said underside of said seat top.

6. A chair according to claim 2, wherein said lever is carried in said first link element and is adapted to be displaceable along said first direction.

7. A chair according to claim 6, wherein said lever is adapted to be releasably lockable against displacement in said first direction in said first link element, and said lever is adapted to be guided displaceably in said first direction in said second link element.

8. A chair according to claim 1, wherein said second link element is adapted to be displaceable and lockable relative to said guide.

9. A chair according to claim 8, wherein said second link element is continuously adapted to be displaceable and lockable relative to said guide.

10. A chair according to claim 8, wherein said second link element is adapted to be displaceable and lockable relative to said guide in discretely spaced steps.

11. A chair according to claim 8, wherein said first link point is a swivelling bearing secured to said seat carrier.

12. A chair according to claim 8, wherein said lever is carried in said second link element and adapted to be displaceable along said first direction.

13. A chair according to claim 12, wherein an end of said lever is non-displaceably secured to said first link element in said first direction.

14. A chair according to claim 1, wherein said back rest is rigidly secured at an upper free end of said lever.

15. A chair according to claim 1, wherein said back rest is linked at an upper free end of said lever pivotally around an axis parallel to said seat top pivoting axis.

16. A swivel chair comprising a foot with a center column extending upwards therefrom comprising:

a seat carrier attached to said center column, a seat top pivotably attached, close to a front edge of said seat top, to said seat carrier so as to pivot around a horizontal axis, and biased with an upwards directed force against said seat top, rearwardly of said pivot connection, at least one lever extending in a first direction and having an upwards extending portion, a back rest attached to said at least one lever at said upwards extending portion, a first link element attached to said seat carrier under said seat top, and a second link element attached to an underside of said seat top, at least one of said first link element and said link element being displaceably mounted in a guide such that said at least one link element is movable toward or away from the other of said link elements in said first direction of said lever, said at least one lever attached to said seat carrier at said first link element, and spaced therefrom, attached to said second link element, wherein both link elements comprise swivelling axes parallel to said seat top horizontal axis, and wherein a length of said at least one lever, between said first link element and said link element, is variable by displacing at least one of said first link element and said second link element in said first direction of said lever.

* * * * *